United States Patent [19]

Schwenk et al.

[11] Patent Number: 5,037,317

[45] Date of Patent: Aug. 6, 1991

[54] GROUNDING ELEMENT FOR FASTENING AN ALUMINUM COMPONENT

[75] Inventors: Hans M. Schwenk, Straubenhardt; Hans-Ulrich Günther, Pfinztal; Klaus Kern, Straubenhardt, all of Fed. Rep. of Germany

[73] Assignee: Schroff GmbH, Straubenhardt, Fed. Rep. of Germany

[21] Appl. No.: 470,632

[22] Filed: Jan. 26, 1990

[30] Foreign Application Priority Data

Feb. 10, 1989 [DE] Fed. Rep. of Germany ..... 3904011

[51] Int. Cl.[5] ..... H01R 4/66

[52] U.S. Cl. ..... 439/92; 439/874

[58] Field of Search ..... 439/92, 98, 879; 174/845; 361/217

[56] References Cited

U.S. PATENT DOCUMENTS 4,873,763 10/1989 Volonta et al. ..... 439/92 X

FOREIGN PATENT DOCUMENTS 1788554 8/1958 Fed. Rep. of Germany .
1827064 2/1960 Fed. Rep. of Germany .
1099663 2/1961 Fed. Rep. of Germany .
2907417 9/1979 Fed. Rep. of Germany .
3100677 11/1981 Fed. Rep. of Germany .
2368154 5/1978 France ..... 439/874

*Primary Examiner*—Eugene F. Desmond
*Attorney, Agent, or Firm*—Spencer & Frank

[57] ABSTRACT

The invention relates to a grounding element 1 for fastening to an aluminum component 11 and including a corrosion insensitive and wear resistant contact element 3 for the connection of a ground cable 13. In order not to adversely influence the visual impression of the aluminum component 11, the grounding element 1 includes a basic aluminum body 2 which can be welded to the aluminum component 11 and is connected mechanically and electrically with the contact element 3.

9 Claims, 3 Drawing Sheets

GROUNDING ELEMENT FOR FASTENING AN ALUMINUM COMPONENT

BACKGROUND OF THE INVENTION

The invention relates to a grounding element for fastening to an aluminum component and including a corrosion insensitive and wear resistant contact element for the connection of a ground cable.

Such grounding elements are known. Often plane connectors are employed which have a fastening hole and a contact blade that is preferably bent by about 45°. The ground cable equipped with a resilient contact receptacle is pushed onto the contact blade. In order to be able to ensure the required contact reliability even after a certain number of plug-in cycles, the contact blade must be insensitive to corrosion and exhibit low wear. In the past, the grounding element was customarily fastened to an aluminum component by means of a clamping screw or a fastening rivet which passed through the fastening hole in the plane connector and through an opening in the aluminum component. However, in many aluminum components, such as, for example, aluminum front plates on electronic plug-in modules, this manner of connecting the grounding element with an aluminum component is disadvantageous because the screw or rivet head adversely influences the visual impression of the component.

SUMMARY OF THE INVENTION

Based on the above-described prior art, it is therefore the object of the invention to provide a grounding element for fastening to an aluminum component or substrate which provides a way of fastening that does not adversely affect the visual impression of the aluminum component while maintaining lasting reliability of the contact.

This is accomplished by the invention in that the grounding element is provided with a basic or base aluminum body which can be welded to the aluminum component and with which the contact element is connected mechanically and electrically. The grounding element according to the invention is thus constructed of two parts, with the contact element, as before, ensuring durable contact reliability while the basic aluminum body, since it is made of the same material as the aluminum component to be grounded, permits a welded connection. The welded connection, which is preferably produced by means of an electrical resistance welding process, does not present any impairment of the visual impression of the aluminum component while providing for proper electrical conductivity and optimum mechanical strength.

Advisably, the basic aluminum body has a planar, preferably round welding surface from which projects approximately in the center a short and thin pin which is of the same material as, and is connected with, the basic aluminum body. The projecting configuration of the basic aluminum body permits proper welding connections, with the short, thin pin serving as a firing aid for the welding current. Optimum welding results can be realized if the welding surface has a diameter of about 4 to 8 mm and the pin has a diameter of about 0.5 to 1.5 mm as well as a length of 0.5 to 1.5 mm. These features of the invention ensure welds, even on relatively thin-walled aluminum sheets, which cannot be visually discerned on the opposite side of the metal sheet. Even aluminum sheets produced by anodic oxidation can be provided with a grounding element according to the invention without their visual appearance being adversely influenced.

According to a further feature of the invention, the contact element is a plane connector which preferably includes a contact blade that is bent by about 45° onto which the ground cable can be plugged by means of a contact receptacle. Advisably the plane connector is provided with a fastening hole. By appropriate selection of the material, such plane connectors can be easily made so insensitive to corrosion and so wear resistant that the required contact reliability is ensured for a certain number of plug-in cycles. In order to prevent the plane connector from being twisted around the basic aluminum body, the fastening hole may be other than round, preferably polygonal.

In a preferred embodiment of the grounding element according to the invention, the basic aluminum body is connected with the contact element by means of a riveted connection. For this purpose, the basic aluminum body may be provided with a riveting projection which passes through a fastening hole in the contact element. In detail, the arrangement may be such, that the basic aluminum body is configured as a component which has a multiply stepped diameter. The welding surface and the pin are arranged at one end of the cylindrical section having the largest diameter and the riveting projection at the other end. This configuration of the basic aluminum body permits, in a simple manner, a reliable mechanical and electrical connection with the contact element, on the one hand, and with the basic aluminum body, on the other hand.

In an alternative rivet connection between the basic aluminum body and the contact element, the riveting projection has a stepped diameter, with an axial circumferential groove being provided between the thicker and the thinner diameter region. The thus formed rivet collar can easily be beaded by means of a tubular tool so that a rivet connection results which is particularly easily reproduced from a manufacturing technology aspect.

Further types of fastening between the basic aluminum body and the contact element, according to the invention, are distinguished in that both components are provided with coaxial fastening holes through which passes a fastening element. The fastening element may be a separate rivet or a clamping screw.

Although the above-described types of connection between the basic aluminum body and the contact element are considered to be particularly expedient, other types of connections are also conceivable within the scope of the invention. For example, an undercut tongue-and-groove connection may also be employed.

In a further embodiment of the invention, a plane connector blade of the sam material is shaped to the basic aluminum body and the contact element is formed by a corrosion insensitive and wear resistant coating on the plane connector blade. The coating may be applied by a suitable method.

Finally, one advantageous embodiment of the grounding element according to the invention is distinguished by the fact that the basic aluminum body has a diameter that is stepped down several times, that the longitudinal section provided with the welding surface and with the pin serving as a firing aid is adapted with respect to its diameter and length, to the fastening hole in the plane connector and that this longitudinal section is followed by a section having a larger diameter. In this way, the plane connector is held, after the welding process, between the underside of the last-mentioned section and the upper side of the aluminum component so that the welded connection of the grounding element with the aluminum component simultaneously produces a connection between the basic aluminum body and the contact element.

Preferably, the contact elements according to the invention are gold plated in order to ensure optimum contact reliability.

In connection with the drawing figures, the invention will now be described in greater detail with reference to embodiments thereof.

DESCRIPTION OF THE PREFERRED EMBODIMENTS

Figure 1:
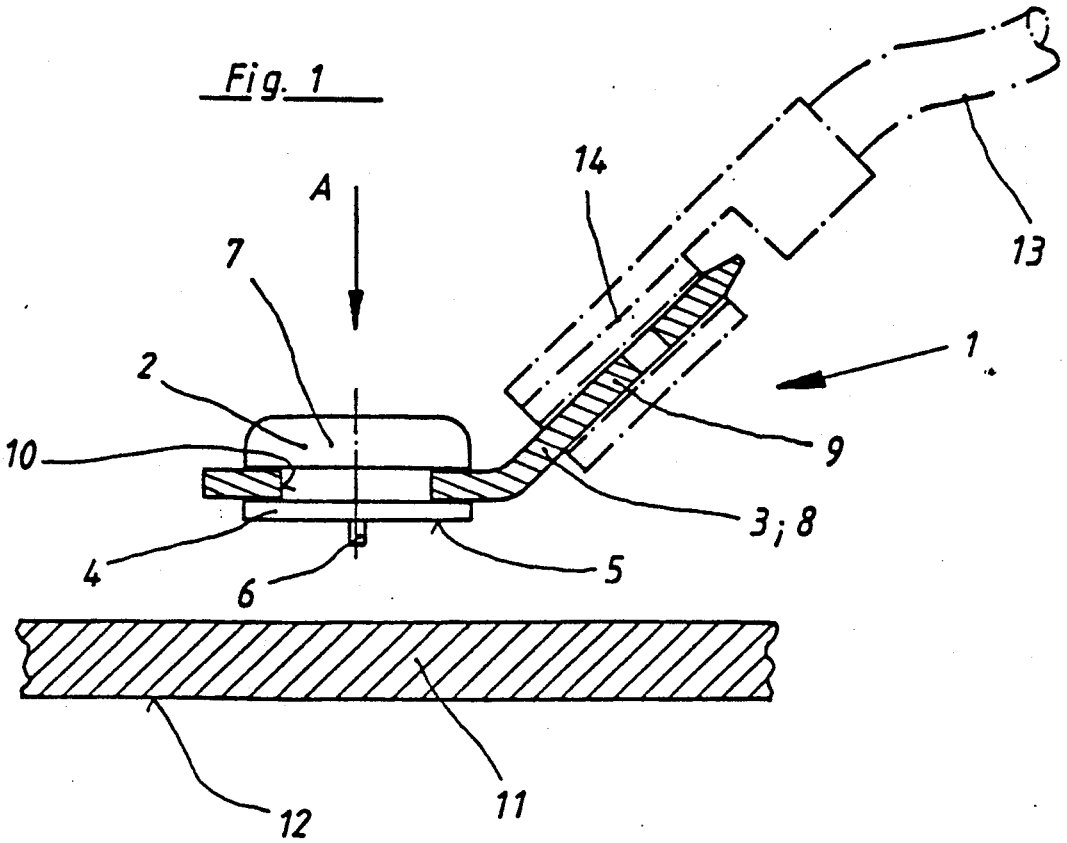
FIG. 1 is a sectional view of a first preferred embodiment of the grounding element according to the invention.
Figure 2:
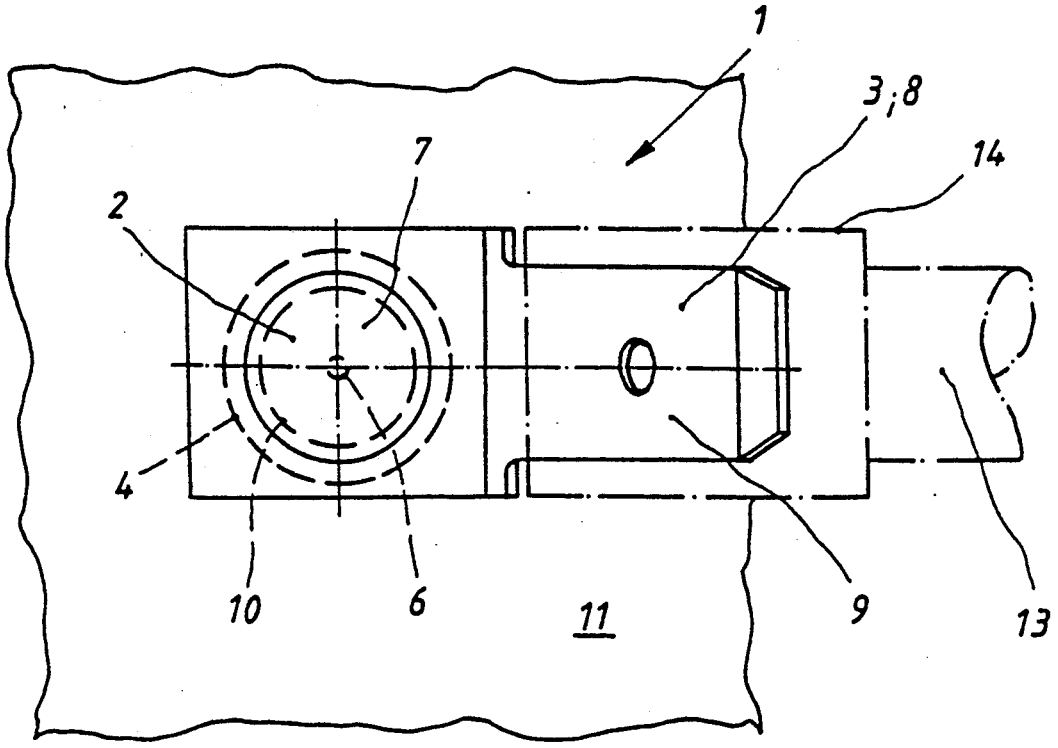
FIG 2 is a plan view of the grounding element according to the invention taken along arrow A in FIG. 1.

The grounding element 1 according to the invention shown greatly enlarged in FIGS. 1 and 2 is configured as two parts and is composed of a basic or base aluminum body 2 and a contact element 3. Basic aluminum body 2 is configured as a component having two steps in its diameter, with the largest diameter cylindrical section 4 having a planar, round welding surface 5 on its underside as well as a central pin 6 and a riveting projection 7 on its upper side. Contact element 3 is formed by a plane connector 8 and includes a contact blade 9 bent by about 45° as well as a fastening hole 10.

The riveting projection 7 of the basic aluminum body 2 surrounds first fastening hole 10 and is riveted to contact element 3 by upsetting in the longitudinal direction A. This results in a durable mechanical and electrical connection between the basic aluminum body 2 and contact element 3. The connection of grounding element 1 with aluminum component 11, here an aluminum plate, is effected by electrical resistance welding, with pin 6 serving as a firing aid. During the welding process, pin 6 melts together with the surface regions of aluminum component 11 and the basic aluminum body 2 so that welding surface 5 lies directly against aluminum component 11 and forms a durable mechanical and electrical connection with the latter. The visual impression of the opposite side 12 of the aluminum component is thus in no way adversely influenced.

A ground cable 13, indicated in dash-dot lines, can be plugged by means of a contact receptacle 14, also shown in dash-dot lines, onto the contact blade 9 of the preferably gold-plated plane connector 8.

Figure 3:
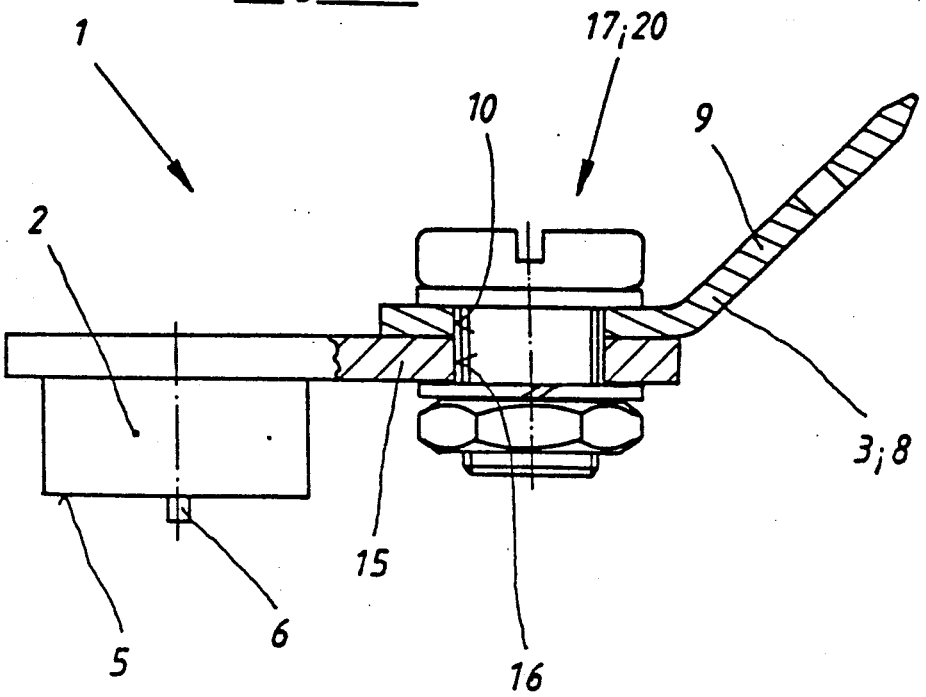
FIG. 3 is a sectional view of a second embodiment of the grounding element according to the invention.

The grounding element 1 of FIG. 3 differs from that shown in FIGS. 1 and 2 by the exterior shape of basic aluminum body 2 and the type of fastening between the latter and contact element 3. In this embodiment as well, basic aluminum body 2 has a round welding surface 5 and a pin 6. In addition, it is provided with a lateral projection 15 in which a second fastening hole 16 has been provided. The connection between basic aluminum body 2 and contact element 3 is here effected by way of a clamping screw 17 which passes through fastening holes 10 and 16 of both components.

Figure 4:
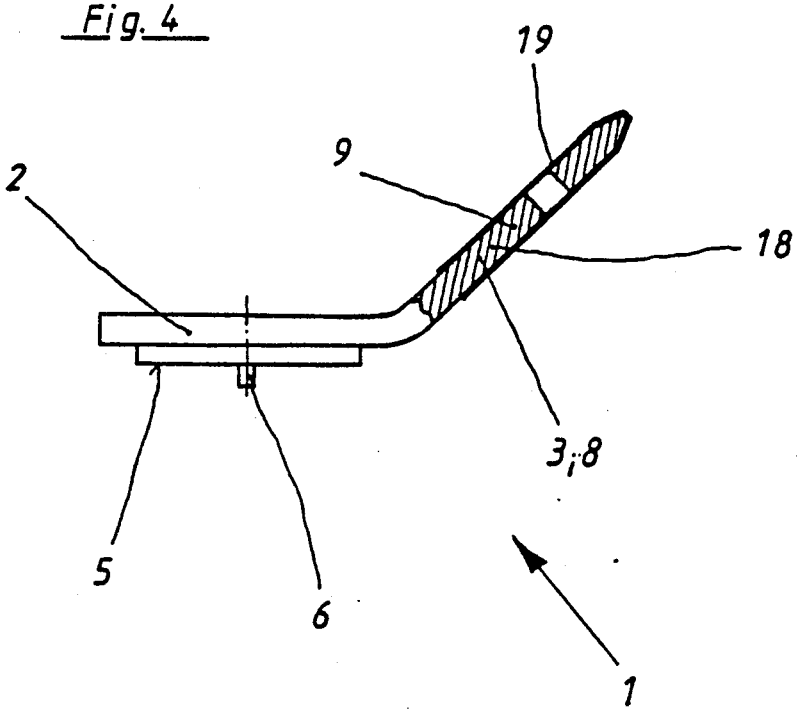
FIG. 4 is a sectional view of a third embodiment of the grounding element according to the invention.

A plane connector blade 18 is shaped in one piece to the basic aluminum body 2 of FIG. 4. By means of a suitable process, a layer 19 which is insensitive to corrosion and wear resistant is applied to the blade. The connection of grounding element 1 with the aluminum component is effected in the same manner as in the embodiments according to FIGS. 1 to 3.

Figure 5:
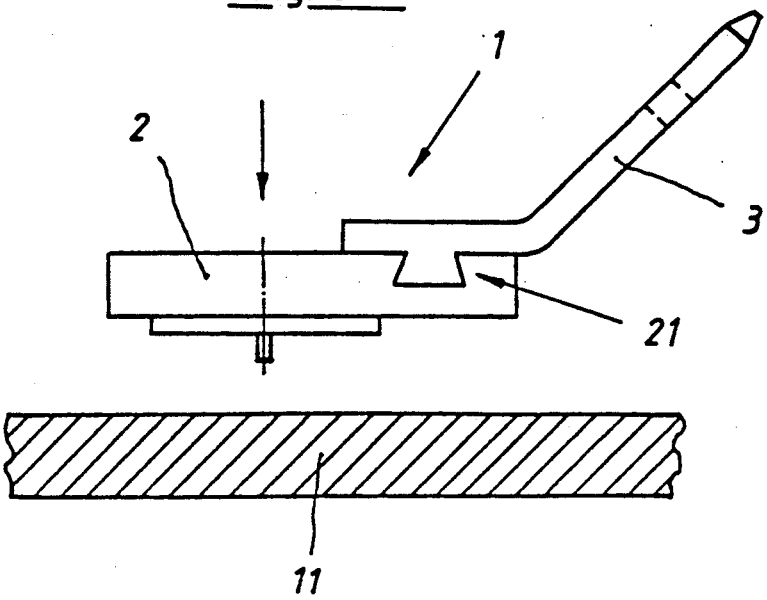
FIG. 5, a partial sectional view of a fourth embodiment of the grounding element according to the invention.

FIG. 5 shows a grounding element 1 according to the invention in which the basic aluminum body 2 is connected with contact element 3 by way of a tongue-and-groove connection 21.

Figure 6:
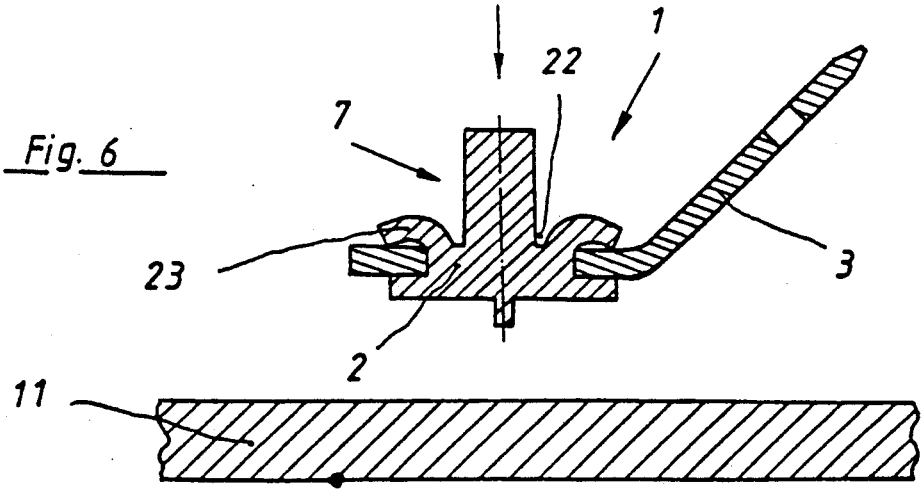
FIG. 6 is a sectional view of a fifth embodiment of the grounding element according to the invention.

The grounding element 1 according to FIG. 6 corresponds essentially to that shown in FIGS. 1 and 2. However, the riveting projection 7 of this basic aluminum body 2 has a stepped diameter, with an axial circumferential groove 22 being disposed in the transition region between the thicker and the thinner diameter section. This results in a riveting collar 2 which in the drawing figure has already been beaded.

Figure 7:
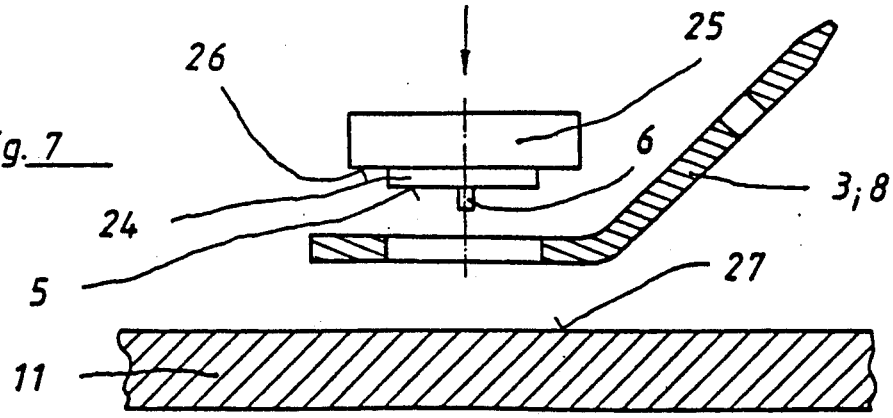
FIG. 7 is a sectional view of a sixth embodiment of the grounding element according to the invention.

In the embodiment according to FIG. 7, a basic aluminum body 2 is employed which is stepped three times in its diameter. The length section 24 provided with welding surface 5 and pin 6 is adapted, with respect to its diameter and length, to fastening hole 10. Length section 24 is followed by a larger diameter section 25. After welding of the basic aluminum body 2 to aluminum component 11, plane connector 8 is held between the underside 26 of section 25 and the upper side 27 of aluminum component 11. With appropriate selection of the tolerances of aluminum component 2 and plane connector 8, plane connector 8 is properly clamped between basic aluminum body 2 and aluminum component 11 once the welded connection has cooled.

In the embodiments according to FIGS. 1, 2 and 5 to 7, it may be advantageous for fastening hole 10 of contact element 3 to be other than round, preferably polygonal.

We claim:

1. A grounding element for grounding a ground cable to an aluminum substrate comprising:

a basic aluminum body weldable to an aluminum substrate;

a substantially flat connector electrically and mechanically connected to said basic aluminum body, said flat connector being corrosion insensitive and wear resistant;

a substantially flat contact blade integrally attached to said flat connector; and a ground cable connecting means disposed on said flat contact blade, said connecting means being configured for receiving a contact receptacle of a ground cable.

2. A grounding element for grounding a ground cable to an aluminum substrate comprising:

a basic aluminum body having a welding portion, said welding portion including means defining a substantially planar circular welding surface;

means attached to said welding portion of said basic aluminum body for welding said basic aluminum body to an aluminum substrate, said welding means comprising a firing aid disposed substantially in the center of said welding surface, said firing aid including an aluminum pin projecting outwardly from said welding surface;

a substantially flat connector electrically and mechanically connected to said basic aluminum body, said flat connector being corrosion insensitive, wear resistant, and defining a plane and having means defining a first fastening hole therethrough; said basic aluminum body extending through said first fastening hole;

a substantially flat contact blade integrally attached to said flat connector; and a ground cable connecting means disposed on said flat contact blade remote from said fastening hole, and said connecting means being configured for receiving a contact receptacle of a ground cable.

3. A grounding element as defined in claim 2, wherein said substantially flat contact blade extends at an angle of about 45° relative to said plane defined by said flat connector.

4. A grounding element as defined in claim 3, wherein said first fastening hole has a nonround configuration.

5. A grounding element as defined in claim 3, wherein said basic aluminum body comprises a riveting projecting extending through said first fastening hole, said riveting projection connecting together said basic aluminum body and said flat connector.

6. A grounding element as defined in claim 3, wherein said basic aluminum body comprises a plurality of cylindrical sections having concentric diameters; said welding surface and said aluminum pin being disposed on the cylindrical section having the largest diameter.

7. A grounding element as defined in claim 6, wherein said basic aluminum body comprises a riveting projection, said riveting projection having a diameter smaller than the diameter of said welding surface; means for defining an axial circumferential groove disposed in a transition region between said riveting projection and the largest diameter cylindrical section so as to define a beadable riveting collar.

8. A grounding element as defined in claim 3, wherein said basic aluminum body comprises a lateral projection; means defining a second fastening hole in said lateral projection; a fastening element extending through and said first and second fastening holes so as to connect said lateral projection and said flat connector.

9. A grounding element as defined in claim 8, wherein said fastening element comprises a rivet.

* * * * *